US008430204B1

(12) United States Patent
Reynolds

(10) Patent No.: US 8,430,204 B1
(45) Date of Patent: Apr. 30, 2013

(54) RAPID RESCUE APPARATUS

(76) Inventor: Marty Reynolds, Greenville, SC (US)

( * ) Notice: Subject to any disclaimer, the term of this patent is extended or adjusted under 35 U.S.C. 154(b) by 243 days.

(21) Appl. No.: 12/185,340

(22) Filed: Aug. 4, 2008

Related U.S. Application Data

(63) Continuation-in-part of application No. 11/821,497, filed on Jun. 22, 2007, now abandoned.

(60) Provisional application No. 60/963,241, filed on Aug. 3, 2007.

(51) Int. Cl.
*A62B 35/00* (2006.01)

(52) U.S. Cl.
USPC ..... 182/3; 2/69; 2/458; 2/85; 2/93

(58) Field of Classification Search ..... 182/3; 2/69, 2/458, 85, 93; 119/857, 770
See application file for complete search history.

(56) References Cited

U.S. PATENT DOCUMENTS

| | | | | | |
|---|---|---|---|---|---|
| 1,357,772 | A | | 11/1920 | Godwin | |
| 2,108,066 | A | | 2/1938 | Kuhlemann | |
| 2,212,746 | A | * | 8/1940 | Nunn | 119/770 |
| 2,647,293 | A | | 8/1953 | Wintercorn | |
| 2,956,541 | A | * | 10/1960 | Rall | 434/254 |
| 2,979,028 | A | | 4/1961 | Zakely | |
| 2,979,153 | A | * | 4/1961 | Hoagland et al. | 182/3 |
| 3,176,793 | A | * | 4/1965 | Hlacia | 182/3 |
| 4,177,877 | A | * | 12/1979 | Gallinati | 182/3 |
| 4,298,091 | A | * | 11/1981 | Anderson | 182/3 |
| 4,553,633 | A | * | 11/1985 | Armstrong et al. | 182/3 |
| 4,625,335 | A | | 12/1986 | Vinai | |
| 4,632,217 | A | * | 12/1986 | Markwell et al. | 182/3 |
| 4,854,418 | A | | 8/1989 | Hengstenberger et al. | |
| 4,872,457 | A | * | 10/1989 | Thompson | 606/121 |
| 5,203,829 | A | * | 4/1993 | Fisk et al. | 119/857 |
| 5,388,551 | A | * | 2/1995 | Martusciello | 119/770 |
| 5,435,272 | A | * | 7/1995 | Epstein | 119/770 |
| 5,542,123 | A | * | 8/1996 | DiPietro | 2/80 |
| 5,957,091 | A | * | 9/1999 | McDonald et al. | 119/770 |
| 5,960,480 | A | * | 10/1999 | Neustater et al. | 2/456 |
| 6,122,778 | A | * | 9/2000 | Cohen | 5/81.1 R |
| 6,205,584 | B1 | * | 3/2001 | Yocco | 2/69 |
| 6,256,789 | B1 | * | 7/2001 | Young et al. | 2/69 |
| 6,405,685 | B1 | * | 6/2002 | Cox | 119/857 |
| 6,450,131 | B1 | * | 9/2002 | Broman | 119/857 |
| 6,467,851 | B1 | | 10/2002 | Mannell et al. | |
| 6,508,389 | B1 | * | 1/2003 | Ripoyla et al. | 224/157 |
| 6,658,666 | B2 | * | 12/2003 | Schweer | 2/94 |
| 6,662,372 | B2 | * | 12/2003 | Lewis et al. | 2/69 |
| 6,698,026 | B2 | * | 3/2004 | Schweer | 2/94 |
| 6,729,511 | B2 | * | 5/2004 | Dent, III | 224/259 |

(Continued)

*Primary Examiner* — Katherine Mitchell
*Assistant Examiner* — Candace L Bradford
(74) *Attorney, Agent, or Firm* — Daniel C. Leonardi; Michael A. Mann; Nexsen Pruet, LLC

(57) ABSTRACT

A rescue harness used to extricate a body from a hazardous position. The harness is quickly and easily donned by a rescuer or wearer and can be stored between a jacket and liner. The apparatus comprises two linked arm loops that are wrapped around the wearer's shoulders. Alternatively, an additional loop comprises a lower torso strap that wraps around the wearer's lower torso and is connected to the upper torso harness with a carabiner. Two smaller continuous loops linked to the arm loops allow the potential rescuer to easily grasp the harness with gloved hands or attach a lifting cable.

16 Claims, 12 Drawing Sheets

U.S. PATENT DOCUMENTS

| | | | | |
|---|---|---|---|---|
| 6,874,596 | B2 * | 4/2005 | Zeissler et al. | 182/3 |
| 6,892,395 | B2 * | 5/2005 | Schweer | 2/94 |
| 7,025,171 | B2 * | 4/2006 | Cox | 182/3 |
| 7,047,567 | B2 | 5/2006 | Allen | |
| 7,086,091 | B2 | 8/2006 | Jordan | |
| 7,341,025 | B1 * | 3/2008 | Streeter et al. | 119/857 |
| 7,665,153 | B2 * | 2/2010 | Grilliot et al. | 2/69 |
| 7,818,818 | B2 * | 10/2010 | Grilliot et al. | 2/94 |
| 7,971,273 | B2 * | 7/2011 | Grilliot et al. | 2/81 |
| 8,011,028 | B2 * | 9/2011 | Grilliot et al. | 2/458 |
| 8,016,335 | B2 * | 9/2011 | McKay | 294/152 |
| 8,061,480 | B2 * | 11/2011 | Grilliot et al. | 182/3 |
| 2004/0163156 | A1 * | 8/2004 | Schweer | 2/69 |
| 2006/0032703 | A1 * | 2/2006 | Burdet | 182/3 |
| 2007/0023231 | A1 * | 2/2007 | Gorman et al. | 182/3 |
| 2007/0044197 | A1 * | 3/2007 | Turcotte et al. | 2/69 |
| 2007/0084667 | A1 * | 4/2007 | Waters et al. | 182/3 |
| 2007/0295555 | A1 * | 12/2007 | O'Rourke | 182/3 |
| 2008/0164095 | A1 * | 7/2008 | Snedeker | 182/3 |

* cited by examiner

RAPID RESCUE APPARATUS

CROSS REFERENCE TO RELATED APPLICATIONS

This continuation-in-part application claims priority to the non-provisional application bearing Ser. No. 11/821,497 filed Jun. 22, 2007 now abandoned, as well as the provisional application bearing Ser. No. 60/963,241 filed Aug. 3, 2007.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF THE INVENTION

This invention relates to safety apparatuses aiding in the extraction of persons from dangerous positions and, more particularly, to safety harnesses or belts which can be quickly and easily donned by potential rescuers or those needing rescue and facilitate dragging of the wearer, or safely lifting or lowering the wearer vertically in a rescue operation.

Rescue workers such as fireman, police officers, paramedics and military personnel and the like often encounter other persons needing extraction from perilous situations. Extraction of the person may require horizontal dragging, dragging up stairs and other inclines, or vertically lifting and lowering. Persons requiring rescue may include persons other than the rescue workers themselves.

Removing a person from a hazardous situation must be accomplished in a manner that best conserves the rescuers time and energy. The person requiring extraction may be incapacitated requiring the rescuer to drag, rather than carry, the person to safety. This can be very tiring to the rescuer, especially when the person is larger than the rescuer. The use of drag harnesses, such as taught by U.S. Pat. Nos. 6,205,584 and 4,854,418, provide the rescuer with an easily grasped strap securely attached to the person's body; however, such harnesses do not allow for self-equalizing the harness when grasped by more than one rescuer. The lack of a self-equalizing feature results in disparate amounts of effort being required of the respective rescuers and makes the harness less comfortable to the person being rescued. It also increases the likelihood that the person being rescued may slip out of the harness. Accordingly, there is a need for a self-equalizing harness that a rescuer can quickly and easily put on a person needing rescue and which allows one or more rescuers to drag the person to safety.

Other harnesses, such as those taught by U.S. Pat. Nos. 7,086,091; 2,108,066; and 1,357,772 provide a device for elevating a person, but incorporate an arrangement of clips and adjustment buckles that complicate donning in an emergency situation and provide limited ability to accommodate equipment, such as air tanks, which are commonly worn by rescue personnel. In addition, the harnesses are not easily incorporated into a fireman's jacket and the bulkiness of such harnesses does not lend to compact storage for carrying by fireman or other rescue personnel. Accordingly, there is also a need for a harness that can be incorporated into a fireman's jacket for quick and easy donning and with a built in rescue harness by which either one or two rescue personnel in a walking position can drag an unconscious fireman to safety.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

According to its major aspects and briefly stated, the present invention is a rescue harness insertable between the shell and separatable liner of a fireman's jacket which includes a large continuous strap arranged in a figure-8 to form a pair of connected loops. The two loops, which encircle the wearer's upper arms and shoulders, have a sliding interconnection thereby securing the wearer within the harness to facilitate the dragging or suspension of the individual. Two relatively smaller independent loops, forming tow loops, are linked to the larger arm loops, respectively, and allow one or two rescuers to easily grasp the harness or attach a lifting cable The herein disclosed rescue harness is insertable between the outer shell of a jacket and the jacket's removable liner. Both the shell and the liner have vertical zipper closures at their front. The two large arm loops encircle the arms of the liner and the small tow loops, which are slidably fastened to the arm loops, pass through a horizontally elongated opening or access slot at the center top of the back of the jacket shell adjacent to the collar of the shell. A hinged flap is secured as by sewing to the outside of the jacket shell between the access slot and the collar of the shell. Hook and loop fasteners (such as VELCRO) secured to the underside of the flap close to mating hook and loop fasteners on the back of the jacket close to laterally opposite ends of the access slot. The two smaller tow loops extend through the access slot. If the person wearing the rescue harness of the present invention is in need of rescue, the tow loops can be utilized by one or two rescuers. Also, rescuers can attach a lifting line to the two loops to lift the wearer out of a dangerous situation.

A laterally extending hook and loop strip is passed through the tow loops and is long enough to extend beyond the loops so that the laterally opposite end portions of the hook and loop strip are contacted by the corresponding hook and loop strips on the jacket and the hook and loop strips on the hinged flap. When the flap is closed, the ends of the tow loops extend through the access slot in the jacket shell and are held in place, just under the flap, for quick access by a rescue person upon opening the flap.

The slidable connections of the small tow loops and larger arm loops allow the harness to self adjust to the individual's size and body shape regardless of whether they are wearing additional equipment. The slidable connections also self-equalize the forces encountered in lifting the individual reducing trauma and reducing the opportunity for the individual to slip from the harness. When not in use, the harness can be quickly returned to its stowed position within the jacket.

An alternative embodiment of the present invention includes the addition of a lower continuous strap forming a loop and designed to fit around the wearer's upper legs and lower torso. The upper arm loops are linked to the lower loop on either side of the slidable connection with a carabiner. This alternative embodiment of the present invention can also be quickly and easily donned by a potential rescuer or wearer, automatically adjusted to secure the individual, and contains a minimal amount of hardware lending to a compact, strong design that the rescuer can easily carry until ready to use.

If the rescuer encounters an incapacitated individual, the device may be attached with the individual in the supine position, the rescuer slides the harness under the individual with the slidable connection of the upper arm loops at the person's back and the large lower loop caudal to the slidable connection. The rescuer places the individual's left arm through the left upper arm loop and the right arm through the right upper arm loop. The rescuer attaches a releasable fastener such as an annular carabiner to the left and right arm loops on the front of the individual. The rescuer brings the lower loop between the individual's legs and attaches it to the releasable fastener. The left side of the lower loop is brought around the left side of the individual and attached to the releasable fastener. Similarly, the right side of the lower loop is brought around the right side of the individual and attached to the releasable fastener. The rescuer grabs the smaller tow loops attached to the upper arm loops and drags the individual to safety, or alternatively, attaches a rope to the tow loops and hoists or lowers the person to safety.

When not in use, the harness can be compactly folded and stowed in a pouch, pocket, or other suitable container. Other features and advantages of the present invention will be apparent to those skilled in the art from a careful reading of the Detailed Disclosure of the Preferred Embodiment presented below and accompanied by the drawings.

BRIEF DESCRIPTION OF THE DRAWINGS

The preferred construction of the invention is illustrated by the accompanying drawings, in which.

DETAILED DESCRIPTION OF THE PREFERRED EMBODIMENT

The present invention is a rapid rescue device. More specifically, the present invention is a harness for use in conjunction with a jacket or jacket and liner and is worn under the jacket and donned with the jacket. Should the wearer become injured or otherwise incapacitated, this harness provides a quick and easy means for one or two rescuers to extricate the wearer from the emergency situation. An alternative embodiment of the present invention is a harness that can quickly and easily be deployed to rescue a person that is in distress or incapacitated.

Figure 1:
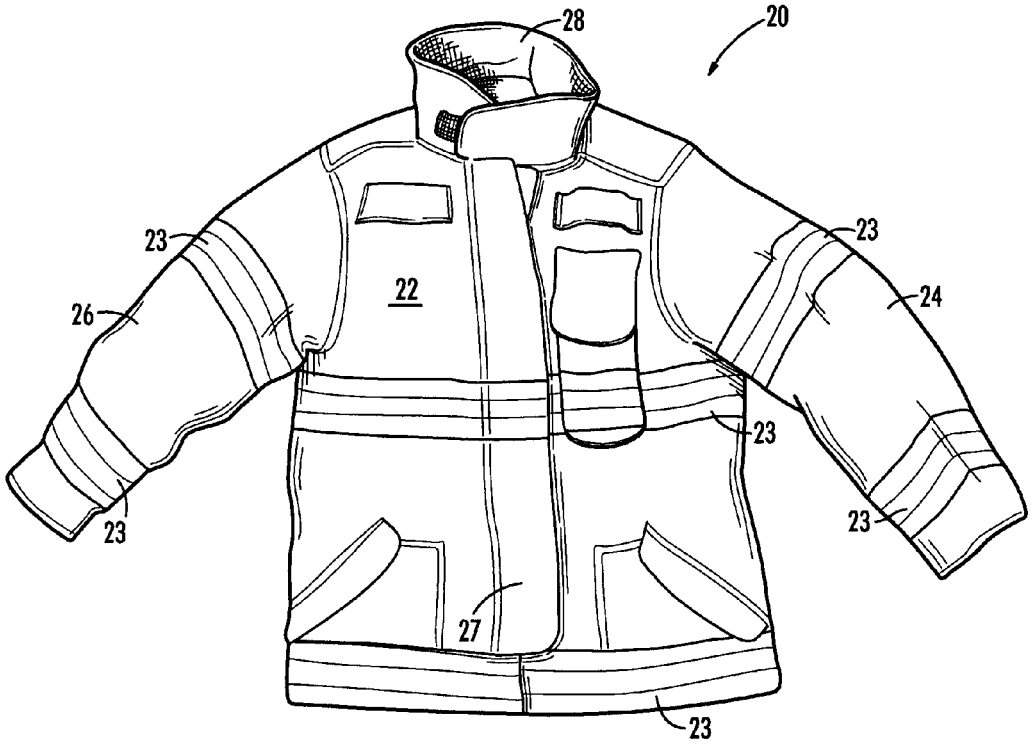
FIG. 1 is a front view of a fireman's jacket of a type suitable for use with the present invention.

FIG. 1 shows a fireman's jacket 20 of the type that would be suitable for use in conjunction with a preferred embodiment of the present invention. The jacket 20 is typically sized to permit the fireman to wear additional clothing underneath the jacket. Furthermore, the jacket 20 is typically comprised of a durable and fire-resistant material 22. Such materials include synthetic fibers such as aramid (KEVLAR) and fire-retardant meta aramid (NOMEX). The jacket 20 also has two sleeves 24 and 26, a collar 28, and a zipper 21 (FIG. 4) under the front flap 27. In the preferred embodiment of the device, the jacket material 22, in addition to being durable and fire resistant, is brightly colored and contains light reflective bands 23.

Figure 2:
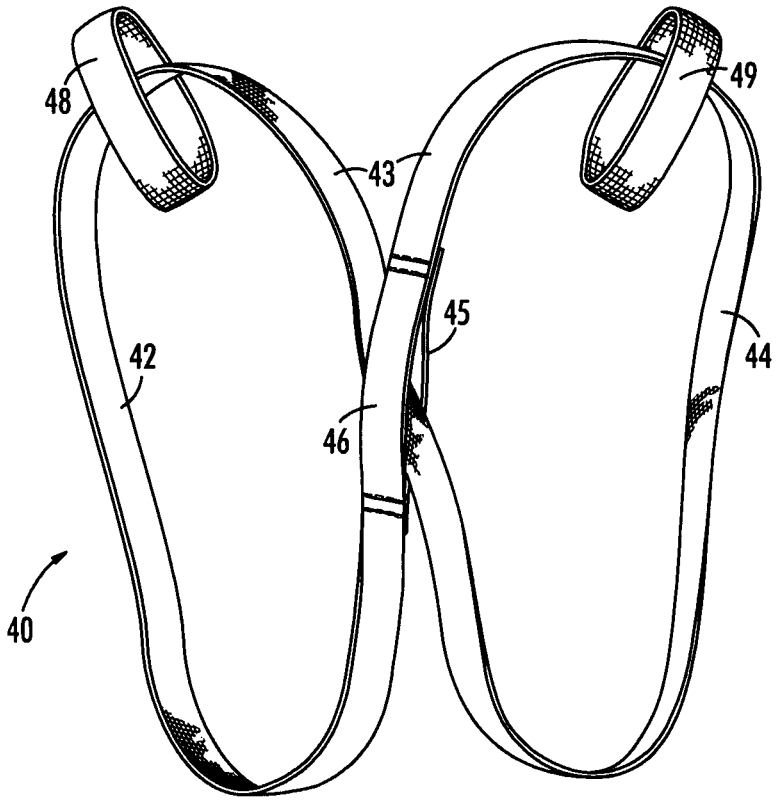
FIG. 2 shows a continuous strap in a figure-8 arrangement forming two loops, each loop having a smaller tow loop, in accordance with a preferred embodiment of the present invention.

FIG. 2 shows a preferred embodiment of the rescue harness 40 of the present invention. The harness is constructed from a sufficiently strong strap material of sufficient length to support and wrap around a human being, or a rescuer carrying equipment such as a self contained breathing apparatus. In this preferred embodiment, the arm loops 42 and 44 are comprised of a continuous strap 43, the ends of which are securely attached to one another. The continuous strap 43 is arranged in a figure-8 and is slidably connected to itself at intersection 46. The slidable connection maintains the harness 40 in a proper configuration for donning, allows for self-equalization of the arm loops 42 and 44, and allows the user to adjust the harness 40 to accommodate the user's body shape and the equipment worn by the user.

In the preferred embodiment of the harness 40 shown in FIG. 2, the slidable connection is accomplished by attaching both ends of an additional short strap segment 45 to the large continuous strap 43. Alternatively, the ends of continuous strap 43, instead of being merely attached to one another, could be overlapped by several inches. The intersecting portion of continuous strap 43 could then be placed between the overlapping ends and substantially perpendicular to the overlapping ends. The overlapping ends could then be attached to one another at either end of the overlap, thereby creating a slidable connection. Alternatively, instead of having one continuous strap 43, two arm loops could be slidably linked using a bracket, metal or plastic loop, or carabiner.

In further reference to FIG. 2, tow loops 48 and 49 are slidably attached to the arm loops 42 and 44. The slidably connected tow loops 48 and 49 are located on opposing sides of intersection 46. This embodiment of the invention accomplishes the slidable connections of tow loops 48 and 49 by passing the large torso strap 43 through tow loops 48 and 49. In yet another alternative version of this invention, each tow loop 48 and 49 is comprised of an item belonging to a group that can be used to easily fasten a rope to and be sufficiently large to accommodate grasping by a rescuer's gloved hand, including, but not limited to; clips, handles, hooks, annular rings, and carabiners.

For attaching the continuous strap 43 to itself and the bridge 45 to the continuous strap 43 at intersection 46, any attachment method known by those in the art to achieve the desired strong connection may be used, including sewing, weaving, and splicing the ends of the straps. While strap material is envisioned as webbing in the preferred embodiment of the invention, the straps may be constructed of rope, wire, leather, fabric and other such strap-like material having high tensile strength, yet flexibly bendable. The strap material could also be a synthetic material, such as aramid or meta aramid.

Figure 3:
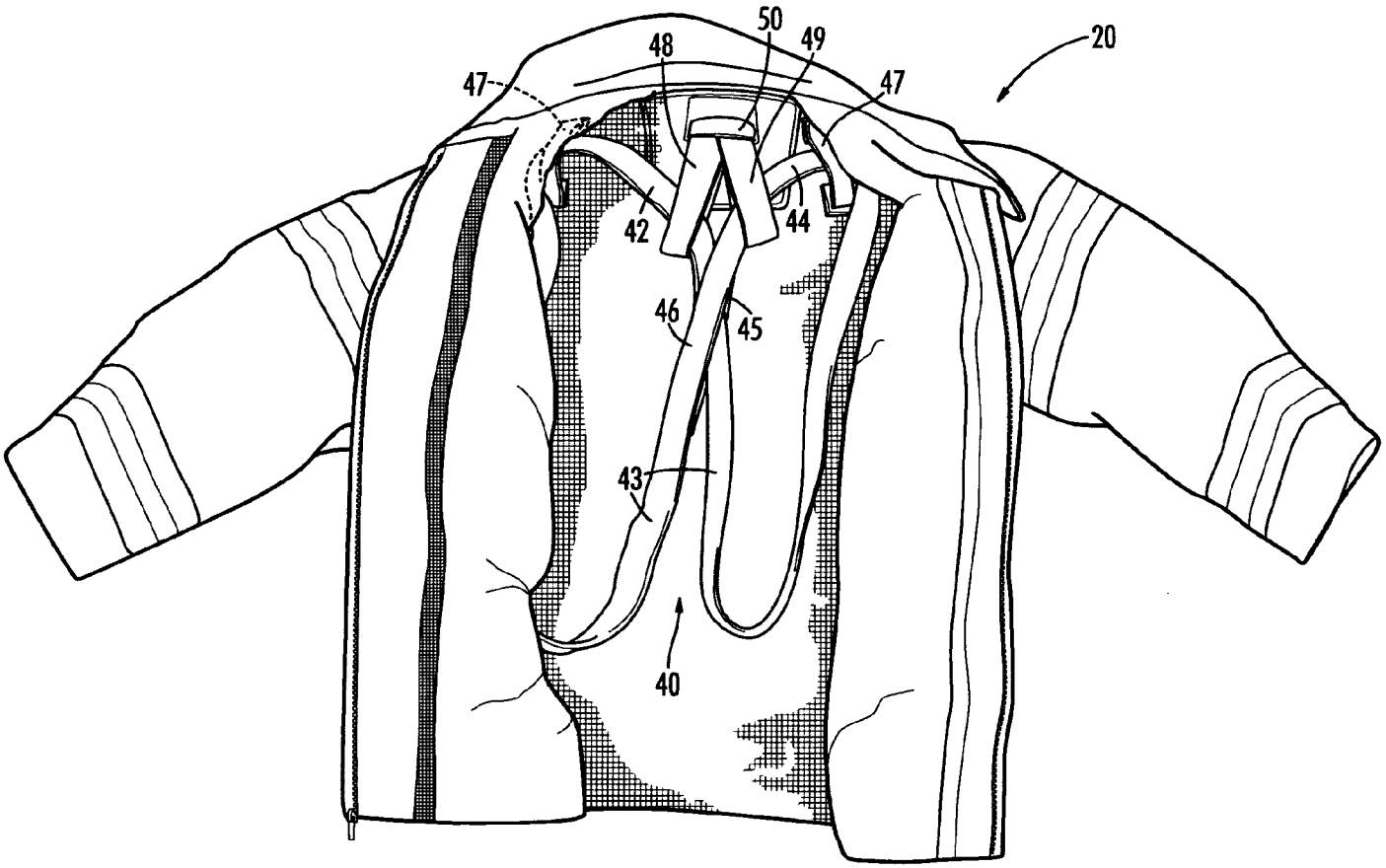
FIG. 3 shows the harness of the present invention installed in the shell of a fireman's jacket.

FIG. 3 shows the rescue harness 40 installed in jacket 20. Note that jacket 20 is equipped with an access slot 50 through which tow loops 48 and 49 extend out of the interior of the jacket. Note also that when tow loops 48 and 49 extend through access slot 50, the tops of arm loops 42 and 44 are positioned near the top of the inside of the jacket 20, ready to be threaded over the user's arms when the user dons jacket 20. In addition, in this embodiment of the present invention, harness 40 is secured to the inside of jacket 20 by retention tabs 47, which can be permanently sewn to jacket 20 or temporarily attached with a hook and loop fastener, snaps, or buttons.

Figure 4:
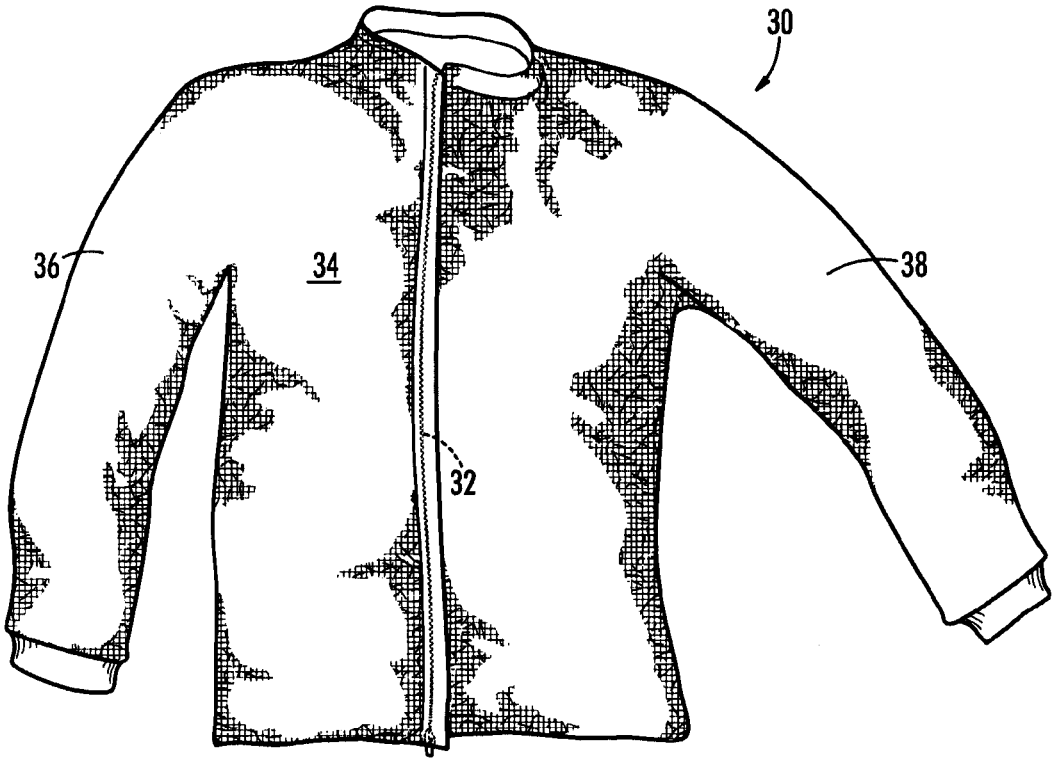
FIG. 4 shows the removable inner liner of a fireman's jacket.

FIG. 4 shows a sleeved liner 30 to be worn inside a fireman's jacket. The liner 30 is typically made of a fire-resistant and insulating material 34 and is sized to be worn inside the fireman's jacket 20 shown in FIG. 1. Like jacket 20, liner 30 has sleeves 36 and 38 and a zipper 32.

Figure 5:
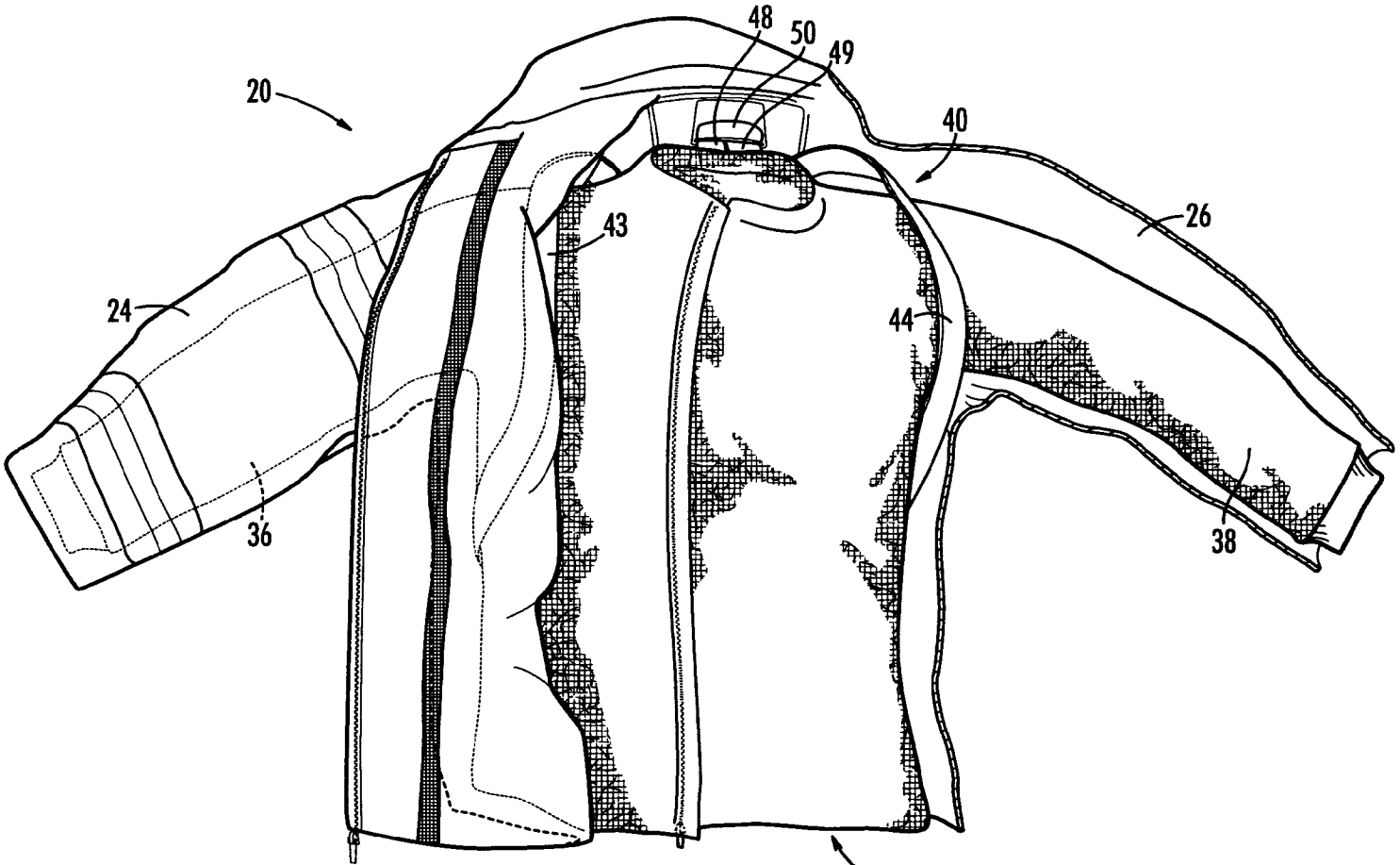
FIG. 5 shows the harness and the liner installed in the fireman's jacket in accordance with a preferred embodiment of the present invention.

FIG. 5 shows a preferred embodiment of the present invention including the outer jacket 20, liner 30, and harness 40. Tow loops 48 and 49 can be seen exiting the jacket 20 through horizontal access slot 50 in the back of jacket 20. An important feature of the present invention is that it is designed to be donned quickly and all-at-once as a single unit. That is, the jacket 20, liner 30, and harness 40 are all donned simultaneously, ensuring that the arrangement seen in FIG. 5 is maintained. Note that arm loops 42 and 44 wrap around the sleeves 36 and 38 of liner 30 and that the liner sleeves 36 and 38 extend into jacket sleeves 24 and 26. This ensures that arm loops 42 and 44 remain wrapped around liner sleeves 36 and 38 and that the harness 40 is properly fitted to the user when the user dons the rapid rescue apparatus.

Figure 6:
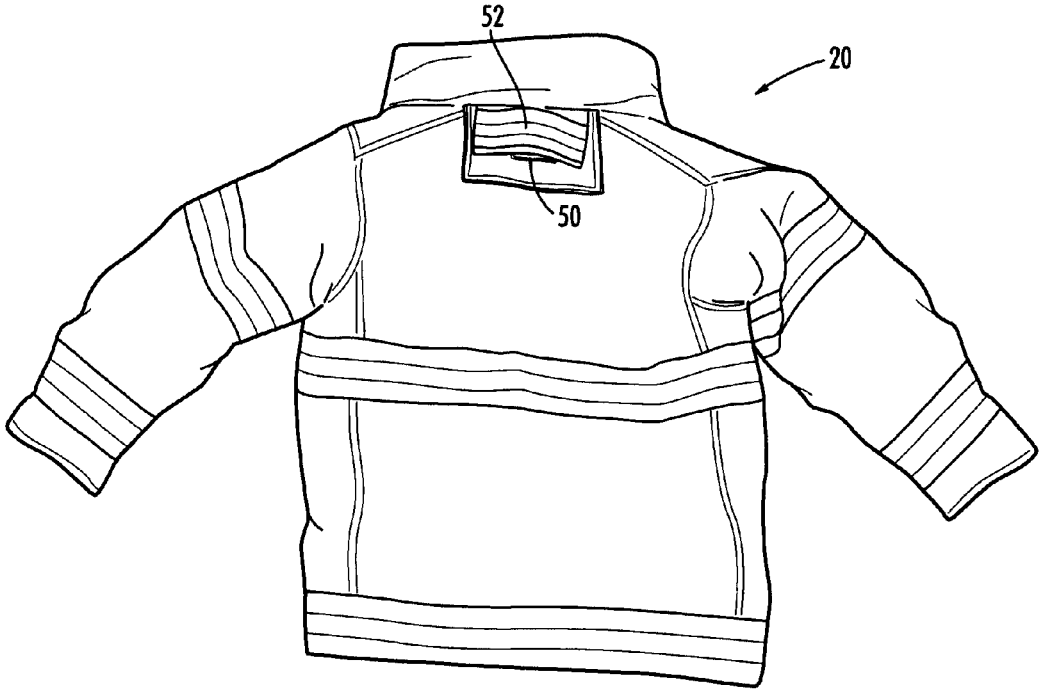
FIG. 6 is a rear view of the fireman's jacket with the access flap in the closed position.

FIG. 6 shows the back of jacket 20 including horizontal access slot 50, which is partially obscured by flap 52. Note that flap 52 is hinged at the top and not at the bottom. This ensures that, as the wearer walks, crawls, or slides through an emergency site, e.g., a burning building or damaged automobile, flap 52 does not get snagged or scraped open thereby permitting tow loops 48 and 49 (FIG. 4) to become snagged.

Figure 7:
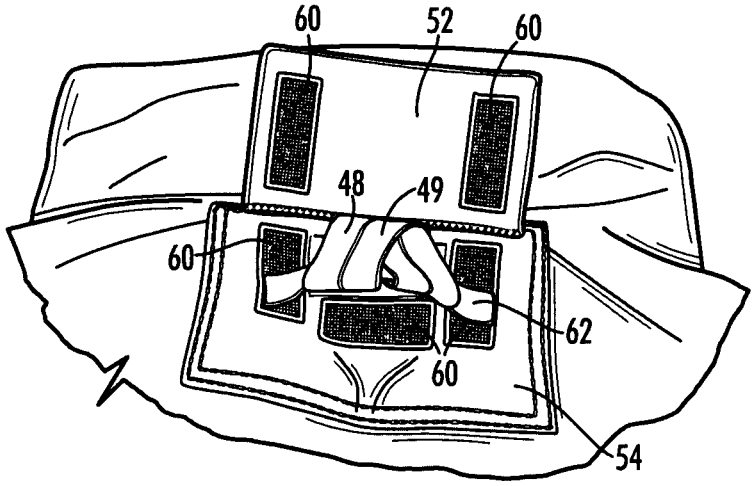
FIG. 7 shows the access flap on the back of the fireman's jacket in the open position.

Referring now to FIG. 7, hook and loop strips 60 permit flap 52 to be releasably closed. Note that there are corresponding hook and loop strips on the flap 52 and the portion 54 of the back of the jacket 20 corresponding to the where the flap 52 contacts the jacket 20 when closed. Note also that there is an additional strip of hook and loop material 62 that is threaded through tow loops 48 and 49 and is sandwiched between flap 52 and jacket back 54. The outside ends of hook and loop strip 62 cooperate with hook and loop strips 60 to ensure that the tow loops 48 and 49 do not become dislodged from flap 52 and jacket back 54, until such time as they are deployed to be used, as seen in FIG. 8.

Figure 8:
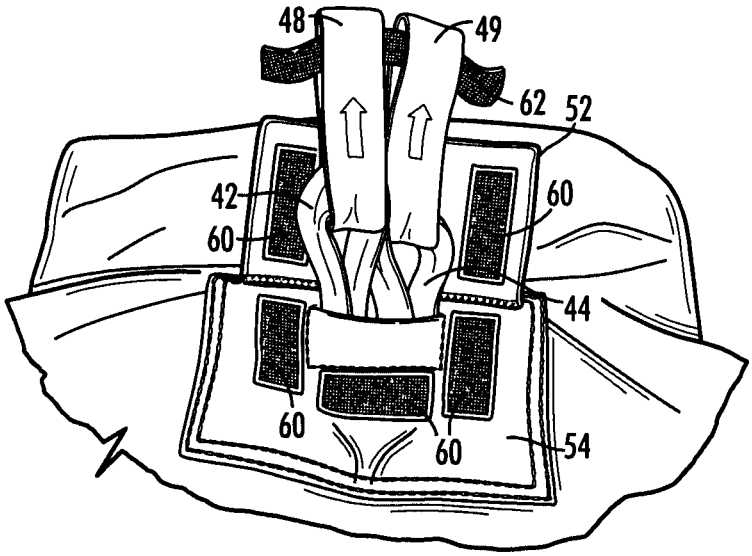
FIG. 8 is a view similar to FIG. 7 showing the tow loops and portions of the arm loops pulled through the slot in the jacket.

FIG. 8 shows hook and loop strip 62 torn free from hook and loop strips 60 so that tow loops 48 and 49 can be pulled through horizontal access slot 52 and away from jacket back 54. When the tow loops 48 and 49 are pulled away from jacket back 54, as would be the case when dragging an incapacitated wearer (FIG. 9), a portion of arm loops 42 and 44 are also pulled through horizontal access slot 50. When a portion of arm loops 42 and 44 are pulled through the horizontal access slot 50, the arm loops 42 and 44 cinch around the users upper torso, ensuring that the wearer does not slide out of the harness 40.

Figure 9:
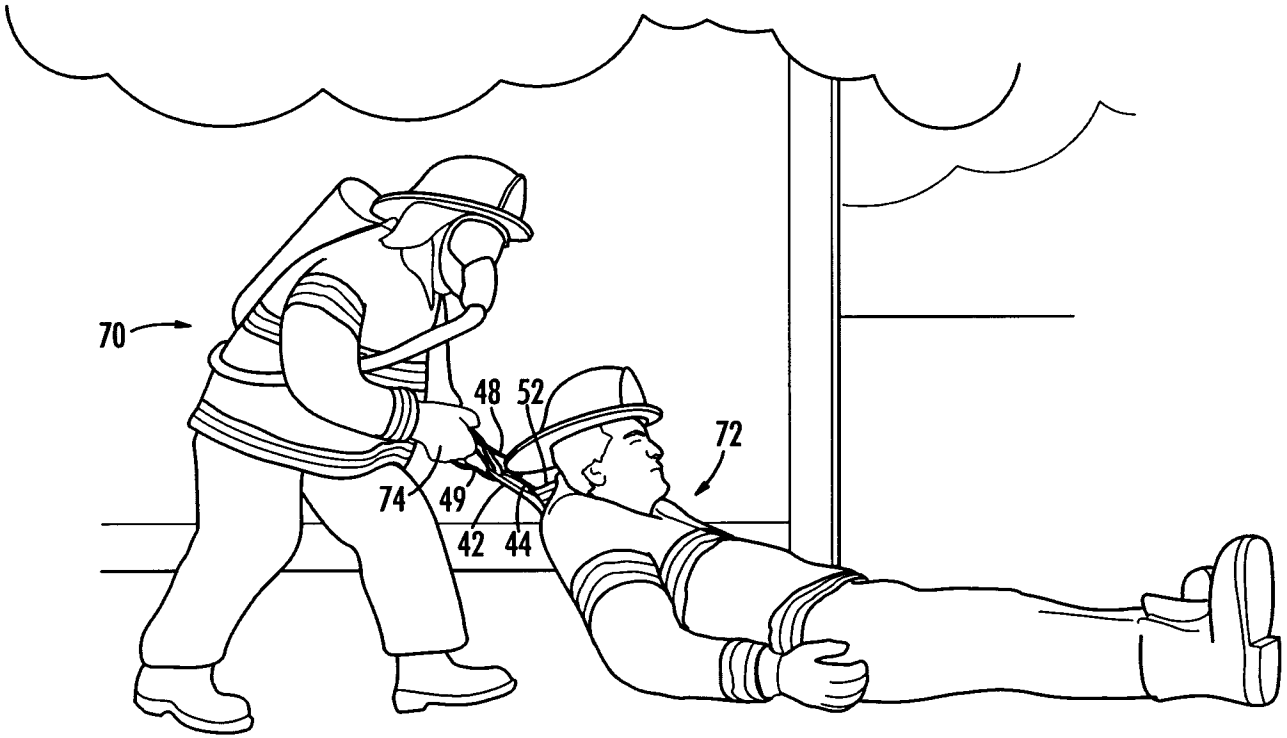
FIG. 9 shows a fireman rescuing another fireman wearing a preferred embodiment of the present invention.

FIG. 9 illustrates the rescuer 70, dragging and otherwise manipulating the individual 72 by grasping tow loops 48 and 49. Note that tow loops 48 and 49 are sufficiently large to allow a rescuer 70 to easily grasp them with gloved hands 74. Once arm loops 42 and 44 have been pulled through access slot 50 (FIG. 8), the rescuer 70 may also grasp the arm loops 42 and 44 to drag the individual 72 to safety. Alternatively, a cable or rope can be attached to tow loops 48 and 49 or arm loops 42 and 44.

Figure 10:
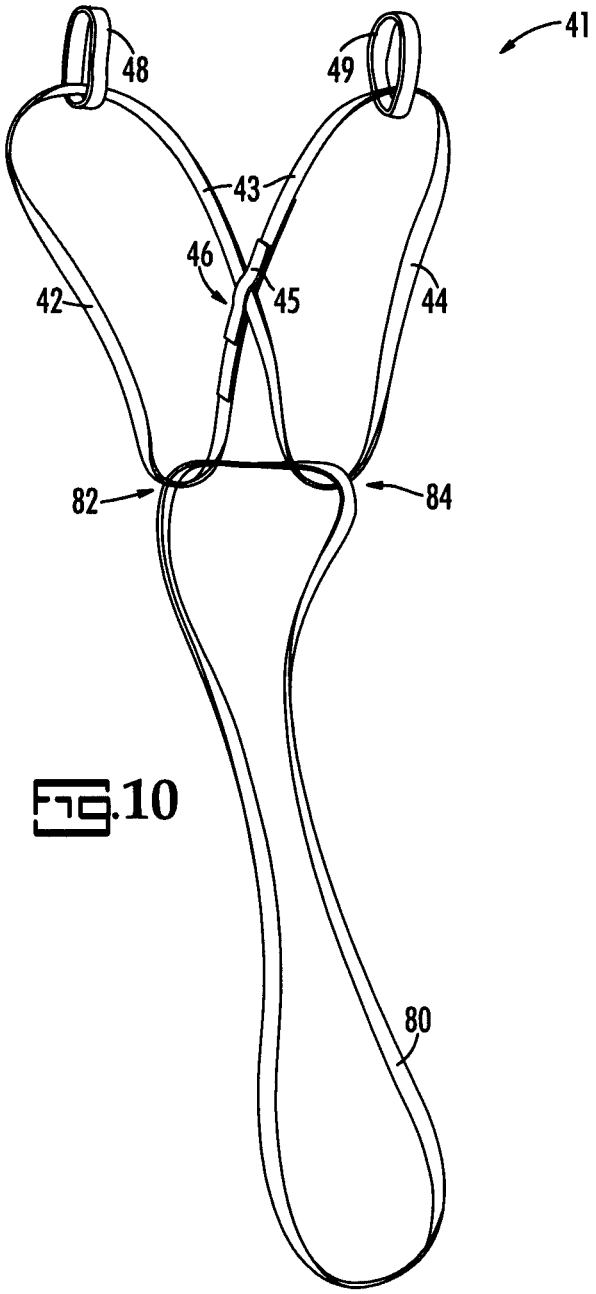
FIG. 10 shows an alternative embodiment of the present invention having a lower torso loop in addition to the arm and tow loops.

FIG. 10 illustrates an alternative embodiment 41 of the present invention. This embodiment comprises two large linked continuous loops 43 and 80. The lower loop 80 is designed to fit around the upper legs and pelvis of the wearer. As with the first embodiment, the two smaller tow loops 48 and 49 are slidably linked to the larger upper loop 43 and permit the potential rescuer to easily grasp the harness 41 or attach a lifting cable.

The large lower loop 80 is slidably connected to the upper torso strap 43 at two locations 82 and 84. The connections at 82 and 84 are located on either side of the intersection 46. In this embodiment of the invention the slidable connections 82 and 84 are accomplished by looping the lower torso strap 80 through the two loops of the upper torso strap 42 and 44 on either side of the intersection 46. Other slidable connections at locations 82 and 84 are envisioned connecting the large lower loop 80 to the large upper strap 43 including brackets, carabiners and other connectors possessing one or more apertures through which the straps may pass.

Figure 11:
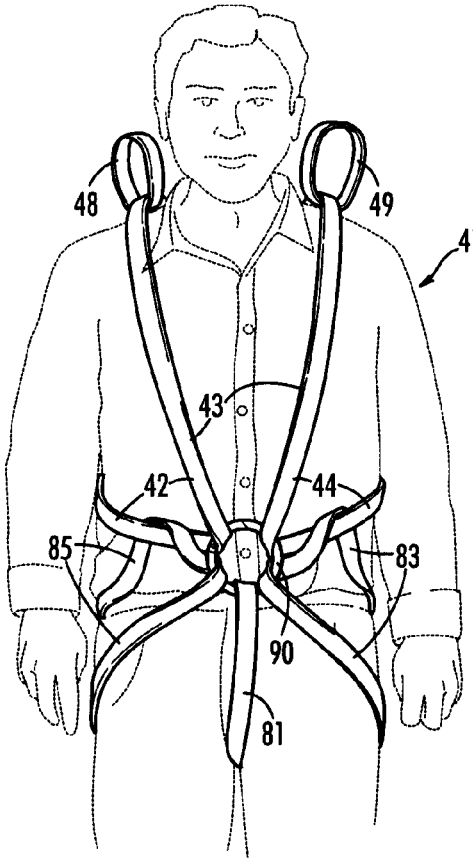
FIG. 11 shows the front of a person wearing an alternative embodiment of the present invention showing the preferred attachment of the harness to the releasable fastener.
Figure 12:
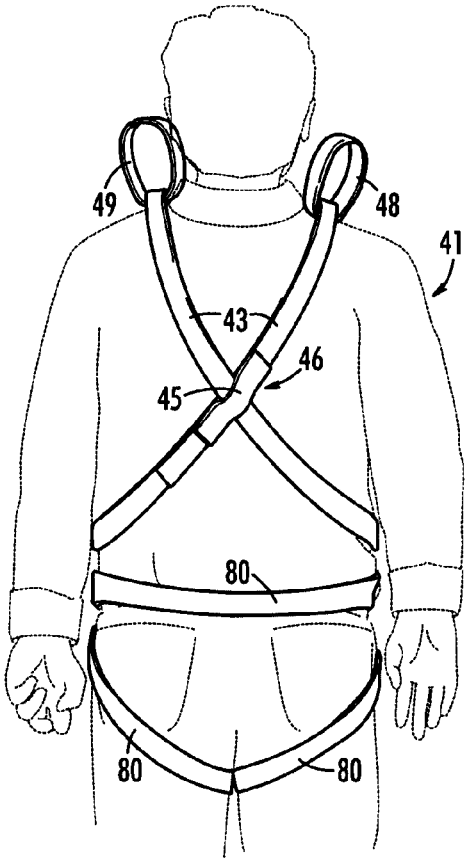
FIG. 12 shows the back of a person wearing an alternative embodiment of the present invention.

FIGS. 11 and 12 show a frontal view and posterior view, respectively, of an individual wearing the harness 41 in the preferred manner. With the individual in a supine position, the harness 41 is slipped under the individual's back with the large lower strap 80 caudal of the large upper strap 43. The rescuer places the slidable intersection 46 of the large upper strap 43 under the individual's back. The small tow loops 48 and 49 should be located at the individual's head. A portion 81 of the large lower strap 80 is wrapped between the individual's legs and connected to a releasable fastener 90 positioned approximately at the individual's navel. Another portion 83 of the large lower strap 80 is brought around the individual's left side and left leg and connected to the releasable fastener 90. The rescuer then brings portion 85 of the large lower strap 80 around the individual's right side and right leg and connects it to the releasable fastener 90. The rescuer places the individual's left arm through the left loop 44 of the large upper strap 43 then connects that portion of the large upper strap to the releasable fastener 90. Lastly, the rescuer places the individual's right arm through the right loop 42 of the large upper strap 43 then connects that portion of the large upper strap to the releasable fastener 90.

Figure 13:
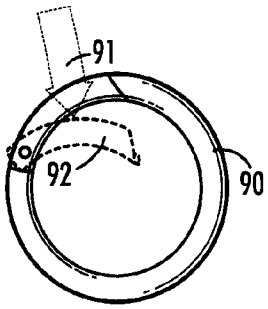
FIG. 13 is an elevated view of the releasable fastener.

FIG. 13 depicts an annular carabiner as the preferred releasable fastener 90. The carabiner 90 possesses a pivotally attached spring loaded gate 92 by which the straps 43 and 80 can be slidably connected to the releasable fastener 90. The gate 92 opens when an inwardly directed force 91 is applied to the gate 92 and returns to the closed position shown by the solid lines upon release of the inwardly directed force 91.

Figure 14:
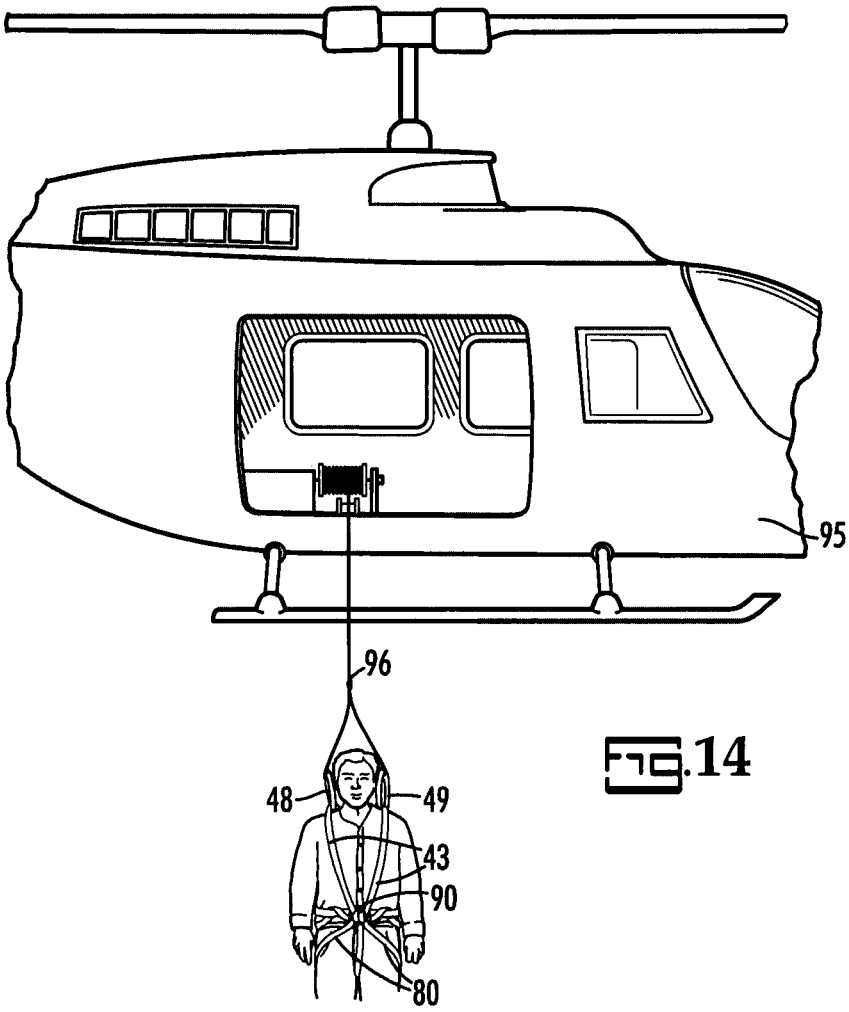
FIG. 14 is an illustrative frontal view of a helicopter elevating an individual wearing an alternative embodiment of the present invention.
Figure 15:
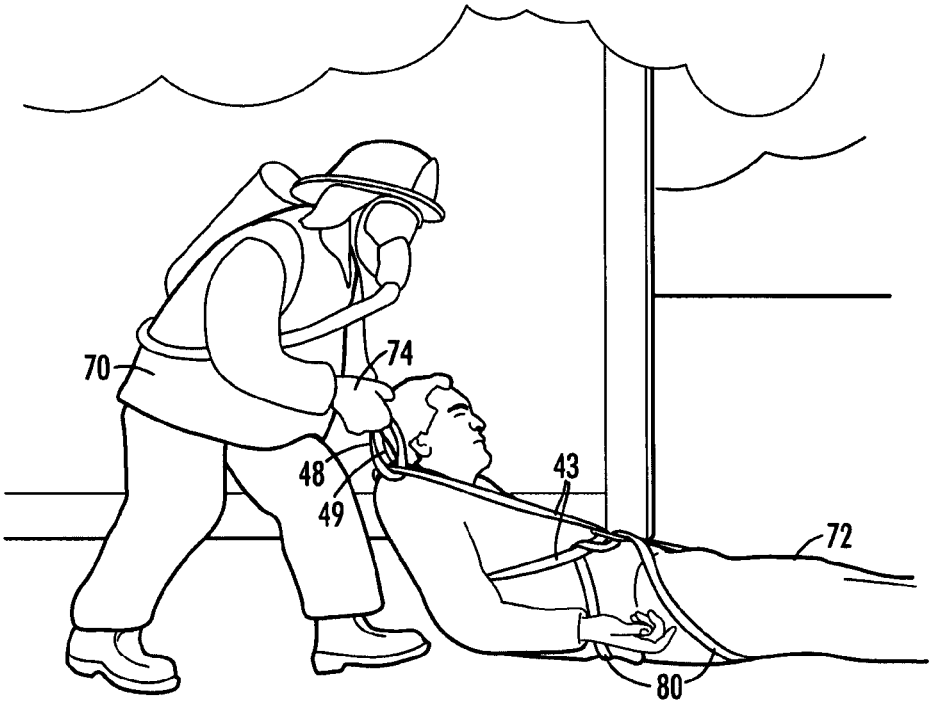
FIG. 15 is an illustrative side view of a rescuer dragging an individual wearing an alternative embodiment of the present invention.

FIG. 14 depicts a rescue aircraft 95 elevating the harnessed individual. The cable 96 is attached through tow loops 48 and 49. FIG. 15 illustrates the rescuer 70 dragging and otherwise manipulating the individual 72 by grasping tow loops 48 and 49. Tow loops 48 and 49 are sufficiently large to allow a rescuer 70 to easily grasp with gloved hands 74. Alternately the rescuer 70 may grasp the left and right arm loops 42 and 44 (FIG. 11) of strap 43 or attach the cable to the same.

Those skilled in the art of rescue harnesses and other rescue devices will recognize that many substitutions and modifications can be made in the foregoing preferred embodiments without departing from the spirit and scope of the present invention.

What is claimed is:

1. A rapid rescue apparatus, comprising:

an upper torso harness defining two loops interconnected so that as a first loop of said two loops is made larger, a second loop of said two loops is made smaller;

two tow loops each separately interconnected with a respective one of said loops of said upper torso harness so that, when at least one of said two tow loops is pulled, said upper torso harness cinches to the body of a user; and a jacket, said jacket comprising a shell, said shell comprising a back, said upper torso harness carried by said shell, said back of said shell having an access slot therethrough, said two tow loops extending through said access slot in said back of said shell so that, when said apparatus is worn by said user, said two tow loops are accessible from outside of said shell.

2. The apparatus of claim 1 wherein, when said two tow loops are pulled with different force, said upper torso harness cinches to the body of a user substantially equally.

3. The apparatus of claim 1 wherein said upper torso harness is a continuous strap having a crossing point, said crossing point defining two loops in a figure 8.

4. The apparatus of claim 3, further comprising a strap segment with two ends affixed to said upper torso harness on both sides of said crossing point, said additional strap holding said upper torso harness in said figure 8.

5. The apparatus of claim 1, wherein said upper torso harness is made of a synthetic fiber material selected from the group consisting of aramid, meta-aramid, nylon, and polypropylene.

6. The apparatus of claim 1, wherein said upper torso harness is fluorescent.

7. An emergency rescue apparatus comprising:

a continuous lower torso strap;

an upper torso harness defining two loops interconnected so that as a first loop of said two loops is made larger, a second loop of said two loops is made smaller, said upper torso harness being interconnected with said lower torso strap;

two tow loops each separately interconnected with a respective one of said loops of said upper torso harness so that, when at least one of said two tow loops is pulled, said upper torso harness cinches to the body of a user; and a jacket, said jacket comprising a shell, said shell comprising a back, said upper torso harness carried by said shell, said back of said shell having an access slot therethrough, said two tow loops extending through said access slot in said back of said shell so that, when said apparatus is worn by said user, said two tow loops are accessible from outside of said shell.

8. The apparatus of claim 7, wherein said lower torso strap is dimensioned to extend around the legs and seat of a user and be releasably fastenable to said upper torso harness.

9. The apparatus of claim 7, wherein said lower torso strap connects to said two loops of said upper torso harness by passing through said two loops.

10. The apparatus of claim 7 wherein said upper torso harness is made of a high strength synthetic fiber material selected from the group consisting of aramid, meta-aramid, nylon, and polypropylene.

11. The apparatus of claim 7, wherein said upper torso harness is luminescent.

12. The apparatus of claim 7 wherein said jacket further comprises:

a removable liner, wherein said upper torso harness is worn between said removable liner and said shell.

13. The apparatus of claim 7 wherein said jacket further comprises:

a first hook and loop fastener attached to said shell adjacent to said access slot;

a hinged flap attached to said shell and having a second hook and loop fastener attached thereto;

said hinged flap positioned with respect to said first hook and loop fastener and said access slot so that said first hook and loop fastener can be removably attached to said second hook and loop fastener and so that, when said two tow loops extend through said access slot, said hinged flap can be used to removably secure said two tow loops under said hinged flap.

14. The apparatus of claim 13 wherein said shell further comprises:

a collar; and wherein said access slot is on said back of said shell, below said collar, and said hinged flap is attached to said shell between said collar and said access slot.

15. The apparatus of claim 13 wherein said jacket further comprises:

a hook and loop strip dimensioned to extend through said two tow loops and contact said first hook and loop fastener on said shell so that, when said two tow loops extend through said access slot in said shell, said hook and loop strip removably secures said two tow loops at said access slot so that said two tow loops are accessible from outside of said shell.

16. The apparatus of claim 7 wherein said jacket further comprises a plurality of retention tabs attached to said shell, said retention tabs positioned and dimensioned to secure said upper torso harness within said jacket so that, when said user dons said jacket, said two loops of said upper torso harness are positioned to be threaded over said user's arms.

* * * * *